US005395488A

United States Patent [19]

Scharbert et al.

[11] Patent Number: 5,395,488

[45] Date of Patent: Mar. 7, 1995

[54] ELECTROCHEMICAL PROCESS FOR REDUCING OXALIC ACID TO GLYOXYLIC ACID

[75] Inventors: Bernd Scharbert, Frankfurt am Main; Pierre Babusiaux, Lillebonne, both of Germany

[73] Assignee: Hoechst Aktiengesellschaft, Frankfurt am Main, Germany

[21] Appl. No.: 66,533

[22] Filed: May 24, 1993

[30] Foreign Application Priority Data

May 26, 1992 [DE] Germany ..... 42 17 338.8

[51] Int. Cl.[6] ..... C25B 3/00

[52] U.S. Cl. ..... 204/73 R; 204/72; 204/74; 204/75; 204/76

[58] Field of Search ..... 204/72, 73 R, 74, 75, 204/76, 77

[56] References Cited

U.S. PATENT DOCUMENTS

| | | | |
|---|---|---|---|
| 3,779,875 | 12/1973 | Michelet | 204/76 |
| 3,929,613 | 12/1975 | Michelet | 204/77 |
| 4,692,226 | 9/1987 | Gimenez et al. | 204/73 R |
| 4,707,226 | 11/1987 | Dapperheld | 204/81 |

FOREIGN PATENT DOCUMENTS

| | | |
|---|---|---|
| 0221790 | 5/1987 | European Pat. Off. . |
| 2151150 | 3/1973 | France . |
| 347605 | 1/1920 | Germany . |
| 2240759 | 4/1975 | Germany . |
| 2359863 | 3/1977 | Germany . |
| 91/19832 | 12/1991 | WIPO . |

OTHER PUBLICATIONS

Goodridge, F., et al., *J. Appl. Electrochem.* Scale-up studies of the electrolytic reduction of oxalic to glyoxylic acid, 1980. pp. 55-60, no month available.

*Primary Examiner*—John Niebling
*Assistant Examiner*—Arun S. Phasge

[57] ABSTRACT

The present invention describes a process for preparing glyoxylic acid by electrochemical reduction of oxalic acid in aqueous solution in divided or undivided electrolytic cells, wherein the cathode comprises from 50 to 99.999% by weight of lead and the aqueous electrolysis solution in the undivided cells or in the cathode compartment of the divided cells in addition contains at least one salt of metals having a hydrogen overpotential of at least 0.25 V, based on a current density of 2500 A/m$^2$, and a mineral acid or organic acid.

The process according to the invention has the advantage that a highly pure, expensive lead cathode can be dispensed with and industrially available lead-containing materials can be used, for example alloys which, in addition to lead, comprise at least one of the metals V, Sb, Ca, Sn, Ag, Ni, As, Cd and Cu. Periodic rinsing with nitric acid can be dispensed with.

20 Claims, No Drawings

ELECTROCHEMICAL PROCESS FOR REDUCING OXALIC ACID TO GLYOXYLIC ACID

DESCRIPTION

The present invention relates to a process for preparing glyoxylic acid by electrochemical reduction of oxalic acid.

Glyoxylic acid is an important intermediate in the preparation of industrially relevant compounds and can be prepared either by controlled oxidation of glyoxal or by electrochemical reduction of oxalic acid.

The electrochemical reduction of oxalic acid to give glyoxylic acid has been known for a long time and is generally carried out in an aqueous, acidic medium, at low temperature, on electrodes having a high hydrogen overpotential, with or without the addition of mineral acids and in the presence of an ion exchanger membrane (German Published Application 458 438).

The conventional electrolytic processes used hitherto involving oxalic acid on an industrial scale, or experiments with prolonged electrolysis did not give satisfactory results, since the current yield fell off significantly as the electrolysis progressed (German Published Application 347 605) and the generation of hydrogen increased.

To overcome these drawbacks, the reduction of oxalic acid was carried out on lead cathodes in the presence of additives, for example tertiary amines or quaternary ammonium salts (German Laid Open Applications 22 40 759, 23 59 863). The concentration of the additive in these cases is between $10^{-5}$% and 1%. This additive is then contained in the glyoxylic acid product and must be removed by a separation process. The documents mentioned do not provide any detailed information on the selectivity of the process.

In Goodridge et al., J. Appl. Electrochem., 10, 1 (1980), pp. 55–60, various electrode materials are studied with regard to their current yield in the electrochemical reduction of oxalic acid. It was found in this study that a hyperpure lead cathode (99.999%) is most suitable for this purpose.

International Patent Application WO-91/19832 likewise describes an electrochemical process for preparing glyoxylic acid from oxalic acid, in which process, however, hyperpure lead cathodes having a purity of more than 99.97% are used in the presence of small amounts of lead salts dissolved in the electrolysis solution. In this process, the lead cathodes are periodically rinsed with nitric acid, as a result of which the service life of the cathodes is reduced. A further drawback of this process consists in the oxalic acid concentration having to be constantly maintained in the saturation concentration range during the electrolysis. The selectivity in this case is only 95%.

It is mentioned in U.S. Pat. No. 4,692,226 that the cathode material used for the electrochemical reduction of oxalic acid to give glyoxylic acid is lead or one of its alloys, preferably with Bi. No further details are provided. In the examples, a 99.99% lead cathode is used.

The object of the present invention is to provide a process for the electrochemical reduction of oxalic acid to give glyoxylic acid, which avoids the drawbacks mentioned above, which, in particular, has a high selectivity, achieves as low as possible an oxalic acid concentration at the end of the electrolysis and uses a cathode having good long-term stability. Selectivity is understood as the ratio of the amount of glyoxylic acid produced to the amount of all the products formed during the electrolysis, namely glyoxylic acid plus by-products, for example glycolic acid, acetic acid and formic acid.

The object is achieved in that the electrochemical reduction of oxalic acid is carried out on cathodes having a lead content of at least 50% and the aqueous electrolysis solution contains salts of metals having a hydrogen overpotential of at least 0.25 V at a current density of 2500 A/m$^2$ and optionally a mineral acid.

The subject of the present invention is therefore a process for preparing glyoxylic acid by electrochemical reduction of oxalic acid in aqueous solution in divided or undivided electrolytic cells, wherein the cathode comprises from 50 to 99,999% by weight of lead and the aqueous electrolysis solution in the undivided cells or in the cathode compartment of the divided cells in addition contains at least one salt of metals having a hydrogen overpotential of at least 0.25 V, preferably at least 0.40 V, based on a current density of 2500 A/m$^2$ and a mineral acid or organic acid.

Of particular interest are cathodes comprising from 66 to 99.96% by weight, preferably from 80 to 99.9% by weight of lead and from 34 to 0.04% by weight, preferably from 20 to 0.1% by weight of other metals.

Surprisingly, a large number of lead-containing materials are suitable as cathodes. In particular, in contrast to WO-91/19832, hyperpure lead is not used. This has the advantage that conventional inexpensive lead alloys can be used as cathodes. Preferred alloy constituents are V, Sb, Cu, Sn, Ag, Ni, As, Cd and Ca, especially Sb, Sn, Cu and Ag. Alloys of interest include those, for example, comprising 99.6% by weight of lead and 0.2% by weight each of tin and silver. Of particular interest are conventional lead alloys such as pipe lead (material No. 2.3201, 98.7 to 99.1% Pb; material No. 2.3202, 99.7 to 99.8% of Pb), shot lead (material No. 2.3203, 94.5 to 96.8% Pb; material No. 2.3205, 93 to 95% Pb; material No. 2.3208, 91.5 to 92.5% Pb), hard lead (material No. 2.3212, 87 to 88% Pb), white metal containing 70 to 80% Pb, type metal, for example PbSn5Sb28 containing 67% Pb, commercial lead (99.9 to 99.94% Pb) or copper lead alloy (99.9% Pb).

The process according to the invention is carried out in undivided or preferably in divided cells. The division of the cells into anode compartment and cathode compartment is achieved by using the conventional diaphragms which are stable in the aqueous electrolysis solution and which comprise polymers or other organic or inorganic materials, such as, for example, glass or ceramic. Preferably, ion exchanger membranes are used, especially cation exchanger membranes comprising polymers, preferably polymers having carboxyl and/or sulfonic acid groups. It is also possible to use stable anion exchanger membranes.

The electrolysis can be carried out in all conventional electrolytic cells, such as, for example, in beaker cells or plate-and-frame cells or cells comprising fixed-bed or fluid-bed electrodes. Both monopolar and bipolar connection of the electrodes can be employed.

The electrolysis can be carried out both continuously and discontinuously.

Possible anode materials are all those materials which sustain the corresponding anode reactions. For example, lead, lead dioxide on lead or other supports, platinum, metal oxides on titanium, for example titanium dioxide doped with noble metal oxides such as platinum oxide on titanium, are suitable for generating oxygen from dilute sulfuric acid. Carbon, or titanium dioxide doped with noble metal oxides on titanium, are used, for example, for generating chlorine from aqueous alkali metal chloride solutions.

Possible anolyte liquids are aqueous mineral acids or solutions of their salts such as, for example, dilute sulfuric or phosphoric acid, dilute or concentrated hydrochloric acid, sodium sulfate solutions or sodium chloride solutions.

The aqueous electrolysis solution in the undivided cell or in the cathode compartment of the divided cell contains the oxalic acid to be electrolyzed in a concentration which is expediently between approximately 0.1 mol of oxalic acid per liter of solution and the saturation concentration of oxalic acid in the aqueous electrolysis solution at the electrolysis temperature used.

Admixed to the aqueous electrolysis solution in the undivided cell or in the cathode compartment of the divided cell are salts of metals having a hydrogen overpotential of at least 0.25 V (based on a current density of 2500 $A/m^2$). Salts of this type which are suitable in the main are the salts of Cu, Ag, Au, Zn, Cd, Hg, Sn, Pb, Tl, Ti, Zr, Bi, V, Ta, Cr, Ce, Co or Ni, preferably the salts of Pb, Sn, Bi, Zn, Cd or Cr. The preferred anions of these salts are chloride, sulfate, nitrate or acetate.

The salts can be added directly or, for example, by the addition of oxides, carbonates or in some cases the metal themselves, can be generated in the solution.

The salt concentration of the aqueous electrolysis solution in the undivided cell or in the cathode compartment of the divided cell is expediently set to approximately from $10^{-6}$ to 10% by weight, preferably to approximately from $10^{-5}$ to 0.1% by weight, based in each case on the total amount of the aqueous electrolysis solution.

It was found, surprisingly, that even those metal salts can be used which, after addition to the aqueous electrolysis solution, form sparingly soluble metal oxalates, for example the oxalates of Cu, Ag, Au, Zn, Cd, Sn, Pb, Ti, Zr, V, Ta, Ce and Co. Thus the added metal ions can be removed from the product solution in a very simple manner, down to the saturation concentration, by filtration after the electrolysis.

The aqueous electrolysis solution in the undivided cell or in the cathode compartment in the divided cell is admixed with mineral acids such as phosphoric acid, hydrochloric acid, sulfuric acid or nitric acid, or organic acids, for example trifluoroacetic acid, formic acid or acetic acid. The addition of mineral acids is preferred, nitric acid being especially preferred.

The concentration of the abovementioned acids is between 0 and 10% by weight, preferably between $10^{-6}$ and 0.1% by weight. If acids are added to the catholyte or to the electrolyte of an undivided cell at the concentrations stated above, the current yield, surprisingly, remains above 70% even after a plurality of experiments carried out in a discontinuous manner, while the current yield in the absence of the acid is distinctly below 70%. At the beginning of the electrolysis it is possible initially to dispense with the addition of acid, if salts of the abovementioned metals are present in the aqueous electrolysis solution at the same time. This is the case, for example, for the first batch in the case of a discontinuous mode of operation or, in the case of a continuous mode of operation, until approximately 90% of the electric charge to be transferred theoretically, based on the proportion of oxalic acid present in the electrolysis circulation at the start of the electrolysis, have passed through. If, however, acid is not added in the subsequent experiments or later on in the electrolysis, the current yield drops from experiment to experiment.

The addition of the abovementioned metal salts can be dispensed with if one or more of the mineral acids mentioned above are present in the aqueous electrolyte solution.

Rinsing the cathode with 10% strength nitric acid in order to regenerate the cathode, as proposed in International Patent Application WO-91/19832 mentioned above, results in heavy erosion of the lead cathode and thus in shortening of the cathode's useful life.

The process according to the invention does not require rinsing with nitric acid, which represents a considerable advantage of the process according to the invention. Surprisingly, the addition of the acids described above in the concentrations stated above does not lead to significant corrosion of the lead cathode.

The current density of the process according to the invention is expediently between 10 and 5000 $A/m^2$, preferably between 100 and 4000 $A/m^2$.

The cell voltage of the process according to the invention depends on the current density and is expediently between 1 V and 20 V, preferably between 1 V and 10 V, based on an electrode gap of 3 mm.

The electrolysis temperature can be in the range from −20° C. to +40° C. It was found, surprisingly, that at electrolysis temperatures below +18° C., even for oxalic acid concentrations below 1.5% by weight, the formation of glycolic acid as a by-product may be below 1.5 mol % compared to the glyoxylic acid formed. At higher temperatures, the proportion of glycolic acid increases. The electrolysis temperature is therefore preferably between +10° C. and +30° C., especially between +10° C. and +18° C.

The catholyte flow rate of the process according to the invention is between 1 and 10,000, preferably 50 and 2000, especially 100 and 1000 liters per hour.

The product solution is worked up by conventional methods. If the mode of operation is discontinuous, the electrochemical reduction is halted when a particular degree of conversion has been reached. The glyoxylic acid formed is separated from any oxalic acid still present according to the prior art previously mentioned. For example, the oxalic acid can be fixed selectively on ion exchanger resins and the aqueous solution free of oxalic acid can be concentrated to give a commercial 50% by weight strength glyoxylic acid. If the mode of operation is continuous, the glyoxylic acid is continuously extracted from the reaction mixture according to conventional methods, and the corresponding equivalent proportion of fresh oxalic acid is fed in simultaneously.

The reaction by-products, especially glycolic acid, acetic acid and formic acid, are not separated, or not completely separated, from the glyoxylic acid according to these methods. It is therefore important to achieve high selectivity in the process, in order to avoid laborious purification processes. The process according to the invention is notable in that the proportion of the sum of by-products can be kept very low. It is between 0 and 5 mol %, preferably below 3 mol %, especially below 2 mol %, relative to the glyoxylic acid.

The selectivity of the process according to the invention is all the more notable in that even if the final concentration of oxalic acid is low, i.e. of the order of 0.2 mol of oxalic acid per liter of electrolysis solution, the proportion of by-products is preferably below 3 mol %, based on glyoxylic acid.

The special advantage of the cathode used according to the invention consists in being able to dispense with a hyperpure, expensive lead cathode and instead to use conventional, commercially available lead-containing materials. Furthermore, it is not necessary to rinse periodically with nitric acid, so that the lead abrasion can be kept very low and a long useful life of the cathode in the industrial process can be achieved.

In the following examples, which explain the present invention in more detail, a divided forced-circulation cell is used which is constructed as follows:

Forced-circulation cell with an electrode area of 0.02 $m^2$ and an electrode gap of 3 mm.

Cathode: Lead (99.6%) with proportions of tin (0.2%) and silver (0.2%)

Anode: dimensionally stable anode for generating oxygen on the basis of iridium oxide on titanium Cation exchanger membrane: 2-layer membrane made of copolymers from perfluorosulfonylethoxyvinyl ether+tetrafluoroethylene. On the cathode side there is a layer having the equivalent weight 1300, on the anode side there is one having the equivalent weight 1100, for example ®Nafion 324 from DuPont;

Spacers: Polyethylene netting

The quantitative analysis of the components was carried out by means of HPLC, the chemical yield is defined as the amount of glyoxylic acid produced based on the amount of oxalic acid consumed. The current yield is based on the amount of glyoxylic acid produced. The selectivity has already been defined above.

EXAMPLE 1 (Comparative Example)

without the addition of salts and acid

Electrolysis conditions:

Current density: 2500 $A/m^2$

Cell voltage: 5–8 V

Catholyte temperature: 16° C.

Catholyte flow rate: 400 l/h

Anolyte: 2N sulfuric acid

Starting catholyte: 2418 g (19.2 mol) of oxalic acid dihydrate in 24 l of aqueous solution Final catholyte after 945 Ah:

Total volume: 25.2 l 0.30 mol/l of oxalic acid 0.44 mol/l of glyoxylic acid chemical yield 95% current yield 62%

The example illustrates the unsatisfactory current yield, even though a fresh lead cathode was used.

EXAMPLE 2 (Comparative Example)

with the addition of lead salts, without the addition of acids

Electrolysis conditions as for Example 1

Starting catholyte (a)

(a) 2418 g (19.2 mol) of oxalic acid dihydrate in 24 l of aqueous solution and addition of 1.76 g of lead(II) acetate trihydrate (40 ppm $Pb^{2+}$)

After the passage of 950 Ah, a sample was taken to determine the current yield, the catholyte was drained, 1300 ml of water were added to the anolyte and a fresh catholyte solution (b) was fed in.

(b) 2418 g (19.2 mol) of oxalic acid dihydrate in 24 l of aqueous solution and addition of 0.022 g of lead (II) acetate trihydrate (0.5 ppm $Pb^{2+}$)

(c) and (d): fresh catholyte solution was added two more times, (c) and (d), as in (b).

In the process, the current yield changed as follows;

(a): 81%

(b): 70%

(c): 67%

(d):60%

After 4 experiments carried out discontinuously and an electric charge transfer of 3800 Ah, corresponding to an electrolysis duration of 76 hours, the current yield had dropped from 81% during experiment (a) to 60% during experiment (d). The current yield of experiment (d) was of the order of the current yield which had been found on a fresh lead cathode without the addition of salts or acids (see Example 1).

EXAMPLE 3 (Comparative Example)

Rinsing with 10% strength nitric acid

Follow-up experiment to Example 2

The electrochemical cell was rinsed, by means of recirculation pumping, with 5 l of 10% strength $HNO_3$ for 20 minutes at approximately 20° C. The lead(II) ion content after the rinsing process was 0.88 g/l, corresponding to a lead abrasion of 4.4 g.

The example confirms the severe corrosion of the lead cathode if rinsing is carried out with nitric acid.

EXAMPLE 4 with the addition of lead salts and nitric acid

Electrolysis conditions as for Example 1

Starting catholyte (a)

(a) 2418 g (19.2 mol) of oxalic acid dihydrate in 24 l of aqueous solution and addition of 1.76 g of lead(II) acetate trihydrate (40 ppm $Pb^{2+}$)

After the passage of 945 Ah, a sample was taken to determine the current yield, the catholyte was drained into a holding tank, 1300 ml of water were added to the anolyte and a fresh catholyte solution (b) was fed in:

(b) 2418 g (19.2 mol) of oxalic acid dihydrate in 24 l of aqueous solution and addition of 0.022 g of lead-(II) acetate trihydrate (0.5 ppm $Pb^{2+}$) and 0.86 ml of 65% strength $HNO_3$ (33 ppm)

The process steps described above under a) were repeated three times, and a fresh catholyte solution (c), (d) and (e) was used as in (b).

In the process, the current yield changed as follows;

(a) 78%

(b) 80%

(c) 71%

(d) 72%

(e) 71%.

The weight of the cathode increased slightly during the electrolysis from 1958.3 g before experiment a) to 1958.9 g after experiment e).

Final catholyte in the holding tank

| | |
|---|---|
| Total volume: | 127 l |
| 0.22 mol/l | oxalic acid (28 mol) |
| 0.52 mol/l | glyoxylic acid (66 mol) |
| 0.0031 mol/l | glycolic acid (0.39 mol) |
| 0.0004 mol/l | formic acid (0.05 mol) |
| 0.0002 mol/l | acetic acid (0.03 mol) |
| Chemical yield | 97% |
| Current consumption | 4725 Ah |
| Current yield | 75% |

-continued

| | |
|---|---|
| Selectivity | 99.3% |

After an initial current yield of 78% during experiment (a), the yield rose to 80% during experiment (b) and then stabilized during the subsequent experiments at values just over 70%.

EXAMPLE 5 with the addition of lead salts and nitric acid

Electrolysis conditions as for Example 1:

Starting catholyte (a)

(a) 2418 g (19.2 mol) of oxalic acid dihydrate in 24 l of aqueous solution and addition of 0.022 g of lead(II) acetate dihydrate (0.5 ppm $Pb^{2+}$) and 0.86 ml of 65% strength $HNO_3$ (33 ppm).

After the passage of 945 Ah, a sample was taken to determine the current yield, the catholyte was drained into a holding tank, 1800 ml of water were added to the anolyte and a fresh catholyte solution (b) was fed in, corresponding to catholyte solution (a), and the process steps described above were repeated three times (b), (c) and (d).

In the process, the current yield changed as follows;

(a) 86%

(b) 73%

(c) 70%

(d) 75%

Final catholyte in the holding tank:

| | |
|---|---|
| Total volume: | 101 l |
| 0.20 mol/l | oxalic acid (20.2 mol) |
| 0.53 mol/l | glyoxylic acid (53.5 mol) |
| 0.0010 mol/l | glycolic acid (0.10 mol) |
| 0.0004 mol/l | formic acid (0.04 mol) |
| Chemical yield | 95% |
| Current consumption | 3780 Ah |
| Current yield | 76% |
| Selectivity | 99.7% |

EXAMPLE 6 with the addition of nitric acid, without the addition of lead salts

Electrolysis conditions as for Example 1

Initial catholyte:

2418 g (19.2 mol) of oxalic acid dihydrate in 24 l of aqueous solution and addition of 0.86 ml of 65% strength aqueous $HNO_3$ Final catholyte after 945 Ah:

| | |
|---|---|
| Total volume | 25.2 l |
| 0.15 mol/l | oxalic acid (3.8 mol) |
| 0.60 mol/l | glyoxylic acid (15.1 mol) |
| 0.0010 mol/l | glycolic acid (0.026 mol) |
| 0.0004 mol/l | formic acid (0.010 mol) |
| Chemical yield | 98% |
| Current yield | 85% |
| Selectivity | 99.7% |

This example shows that, if 65% strength nitric acid is added, it is not necessary to add lead salts, since a sufficient amount of Pb passes into solution from the electrode material. In the aqueous electrolysis solution, a $Pb^{2+}$ concentration of 0.5 ppm was measured.

EXAMPLE 7

Catalytic effect of added metal salts

Prior to each experiment, the cathode was rinsed with 2 l of 10% strength nitric acid for approximately 10 minutes at approximately 25° C.

Electrolysis conditions as for Example 1

During the experiment, the amount of hydrogen generated at the cathode was measured.

Initial catholyte:

403 g (3.2 mol) of oxalic acid dihydrate in 4000 ml of water a) without addition of a metal salt b) with 1.46 g of lead(II) acetate dihydrate c) with 1.67 g of zinc chloride d) with 1.85 g of bismuth(III) nitrate pentahydrate e) with 2.01 g of copper(II) sulfate pentahydrate and f) with 2.85 g of iron(II) chloride tetrahydrate After the passage of 171 Ah, the amount of hydrogen generated at the cathode was as follows:

a) 23.6 l b) 13.1 l c) 11.8 l d) 18.7 l e) 5.4 l f) 17.6 l

The example shows the catalytic effect of the added metal salts, independent of the acid concentration. The metal salts produce a clear decrease in the amount of hydrogen generated, compared to experiment a).

EXAMPLE 8

The electrolysis was carried out similarly to Example 4, except that as the cathode a lead-antimony alloy, material No. 2.3202 having a lead content between 99.7 and 99.8% was used.

The electrolysis was terminated after experiment (d).

In the process, the current yield changed as follows:

(a) 82%

(b) 71%

(c) 72%

(d) 72%

Final catholyte in the holding tank

| | |
|---|---|
| Total volume | 102 l |
| 0.21 mol/l | oxalic acid (21.5 mol) |
| 0.52 mol/l | glyoxylic acid (53 mol) |
| 0.0040 mol/l | glycolic acid (0.41 mol) |
| 0.0004 mol/l | formic acid (0.04 mol) |
| 0.0004 mol/l | acetic acid (0.04 mol) |
| Chemical yield | 96% |
| Current consumption | 3780 Ah |
| Current yield | 74% |
| Selectivity | 99.1% |

EXAMPLE 9

The electrolysis was carried out similarly to Example 4, except that as the cathode a lead-antimony alloy, material No. 2.3205 having a lead content between 93 and 95% was used.

The electrolysis was terminated after experiment (c).

In the process, the current yield changed as follows:

(a) 76%

(b) 73%

(c) 74%

Final catholyte in the holding tank

| | |
|---|---|
| Total volume | 76 l |
| 0.21 mol/l | oxalic acid (16 mol) |
| 0.52 mol/l | glyoxylic acid (39 mol) |
| 0.0046 mol/l | glycolic acid (0.35 mol) |
| 0.0006 mol/l | formic acid (0.04 mol) |
| 0.0011 mol/l | acetic acid (0.08 mol) |
| Chemical yield | 95% |
| Current consumption | 2835 Ah |
| Current yield | 74% |
| Selectivity | 98.9% |

We claim:

1. A process for preparing glyoxylic acid by electrochemical reduction of oxalic acid in solution in a divided or undivided electrolytic cell, comprising:

electrochemically reducing the oxalic acid at a cathode consisting essentially of from 50 to 99.999% by weight of lead and including an aqueous electrolysis solution in the undivided cell or in the cathode compartment of the divided cell which aqueous electrolysis solution contains, at least during a portion of the reducing step, at least one salt of a metal having a hydrogen overpotential of at least 0.25 V, based on a current density of 2500 $A/m^2$, and adding a mineral acid or an additional organic acid that is not oxalic acid.

2. The process as claimed in claim 1, wherein the cathode comprises from 66 to 99.96% by weight of lead and from 34 to 0.04% by weight of other metals.

3. The process as claimed in claim 1, wherein the cathode comprises from 80 to 99.9% by weight of lead and 20 to 0.1% by weight of other metals.

4. The process as claimed in claim 1, wherein the cathode, in addition to lead, comprises at least one of the metals V, Sb, Ca, Sn, Ag, Ni, As, Cd and Cu.

5. The process as claimed in claim 1, wherein the cathode, in addition to lead, comprises at least one of the metals Sb, Sn, Cu and Ag.

6. The process as claimed in claim 1, wherein the cathode comprises 99.6% by weight of lead, 0.2% by weight of Sn and 0.2% by weight of Ag.

7. The process as claimed in claim 1, wherein the cathode comprises from 93 to 95% by weight of lead and from 7 to 5% by weight of antimony.

8. The process as claimed in claim 1, wherein the aqueous electrolysis solution contains, during the portion of the reducing step when the mineral acid or organic acid is present, a current yield-improving amount up to 10% by weight of the mineral acid or organic acid.

9. The process as claimed in claim 8, wherein the mineral acid is nitric acid, phosphoric acid, sulfuric acid or hydrochloric acid.

10. The process as claimed in claim 1, wherein the aqueous electrolysis solution contains from $10^{-6}$ to 0.1% by weight of the mineral acid or organic acid.

11. The process as claimed in claim 1, wherein the concentration of the salts of metals having a hydrogen overpotential of at least 0.25 V, based on a current density of 2500 $A/m^2$, in the aqueous electrolysis solution in the undivided cell or in the cathode compartment of the divided cell is from $10^{-6}$ to 10% by weight, based on the total amount of the aqueous electrolysis solution.

12. The process as claimed in claim 1, wherein the concentration of the salts of a metals having a hydrogen overpotential of at least 0.25 V, based on a current density of 2500 $A/m^2$, in the aqueous electrolysis solution in the undivided cell or in the cathode compartment of the divided cell is from $10^{-5}$ to 0.1% by weight, based on the total amount of the aqueous electrolysis solution.

13. The process as claimed in claim 1, which comprises using, as the salt or salts of metals having a hydrogen overpotential of at least 0.25 V, based on a current density of 2500 $A/m^2$, the salt or salts of Cu, Ag, Au, Zn, Cd, Hg, Sn, Pb, Tl, Ti, Zr, Bi, V, Ta, Cr, Ce, Co, Ni, or a combination thereof.

14. The process as claimed in claim 1, which comprises using a Pb salt as the salt of a metals having a hydrogen overpotential of at least 0.25 V, based on a current density of 2500 $A/m^2$.

15. The process as claimed in claim 1, wherein the current density of the current applied during said reducing step is between 10 and 5000 $A/m^2$.

16. The process as claimed in claim 1, wherein the current density of the current applied during said reducing step is between 100 and 4000 $A/m^2$.

17. The process as claimed in claim 1, wherein the temperature at which the reducing step is carried out is between −20° C. and +40° C.

18. The process as claimed in claim 1, wherein the temperature at which the reducing step is carried out is between +10° C. and +30° C.

19. The process as claimed in claim 1, wherein the oxalic acid concentration in the electrolysis solution is between 0.1 mol per liter of electrolysis solution and the saturation concentration of oxalic acid in the electrolysis solution at the temperature at which the reducing step is carried out.

20. The process as claimed in claim 1, wherein the reducing step is carried out discontinuously or continuously, and the inclusion of the mineral acid or the organic acid is postponed until after the first batch, when the reducing step is carried out discontinuously, or, when the reducing step is carried out continuously, until approximately 90% of the electric charge to be transferred theoretically, based on the proportion of oxalic acid present in circulation at the start of the reducing step, have passed through.

* * * * *